US006090225A

United States Patent [19]

Pichard

[11] Patent Number: 6,090,225

[45] Date of Patent: Jul. 18, 2000

[54] PROCESS FOR MANUFACTURING A CARBURIZED OR CARBONITRIDED STEEL COMPONENT, AND STEEL FOR THE MANUFACTURE OF THIS COMPONENT

[75] Inventor: Claude Pichard, Malancourt la Montagne, France

[73] Assignee: Ascometal (Société Anonyme), Puteaux, France

[21] Appl. No.: 09/112,057

[22] Filed: Jul. 9, 1998

[30] Foreign Application Priority Data

Jul. 10, 1997 [FR] France ..... 97 08770

[51] Int. Cl.[7] ..... C22C 38/22; C23C 8/22; C23C 8/32

[52] U.S. Cl. ..... 148/319; 148/225; 148/218

[58] Field of Search ..... 148/319, 225, 148/218

[56] References Cited

FOREIGN PATENT DOCUMENTS

| | | |
|---|---|---|
| 61-91348 | 5/1986 | Japan . |
| 62-214157 | 9/1987 | Japan . |
| 62-214158 | 9/1987 | Japan . |
| 402221363 | 9/1990 | Japan . |
| 7-97660 | 4/1995 | Japan . |
| 9-53149 | 2/1997 | Japan . |

*Primary Examiner*—Deborah Yee

*Attorney, Agent, or Firm*—Oblon, Spivak, McClelland, Maier & Neustadt, P.C.

[57] ABSTRACT

Process for manufacturing a mechanical component made of steel, in which a blank of the steel component is manufactured and a high-temperature carburizing or carbonitriding treatment of at least part of the surface of the blank of the component is carried out, the chemical composition of the steel of which the component is composed comprises, by weight: $0.15\% \leqq C \leqq 0.35\%$; $0\% \leqq Si \leqq 0.6\%$; $0\% \leqq Mn+Cr+Ni+Mo \leqq 5\%$; $0\% \leqq Al \leqq 0.1\%$; $0\% \leqq Cu \leqq 0.5\%$; $0\% \leqq Ti \leqq 0.05\%$; $0.004\% \leqq N \leqq 0.02\%$; $0\% \leqq S \leqq 0.15\%$; $P \leqq 0.03\%$; optionally, up to 0.02% tellurium, up to 0.04% selenium, up to 0.07% lead, up to 0.005% calcium, the balance being iron and impurities resulting from the smelting; the chemical composition being adjusted so that the Jominy curve of the steel is such that: 45 HRC$\leqq J_3 \leqq$50 HRC; 39 HRC$\leqq J_{11} \leqq$47 HRC; 31 HRC$\leqq J_{25} \leqq$40 HRC; the average values $J_{3m}$, $J_{11m}$ and $J_{25m}$ of five Jominy tests are such that: $|J_{11m}-J_{3m}\times 14/22-J_{25m}\times 8/22| \leqq 2.5$ HRC and $J_{3m}-J_{15m} \leqq 9$ HRC. Carburizing or carbonitriding steel for manufacturing this component.

16 Claims, No Drawings

PROCESS FOR MANUFACTURING A CARBURIZED OR CARBONITRIDED STEEL COMPONENT, AND STEEL FOR THE MANUFACTURE OF THIS COMPONENT

FIELD OF THE INVENTION

The present invention relates to the manufacture of steel components, at least part of the surface of which is hardened by carburizing or carbonitriding, followed by quenching in oil or gas.

PRIOR ART

Many mechanical components made of steel, such as, for example, gears, are surface-hardened by carburizing or carbonitriding. To do this, the components are maintained in a atmosphere rich in carbon or in carbon and nitrogen, at a temperature greater than 900° C. for several hours, so as to enrich the steel with carbon or with carbon and nitrogen over a certain depth beneath the surface by diffusion of these elements from the surface, and then the components are quenched in cold, warm or hot oil, or in gas, so as to harden the surface. The carburizing or carbonitriding operation may also be carried out at a temperature greater than 1000° C.—it is then said to be a high-temperature carburizing or carbonitriding operation.

In order to manufacture such components, steels containing from 0.15% to 0.35% carbon, alloyed with chromium or alloyed with chromium and molybdenum, or else alloyed with chromium and manganese, are used. This technique, which makes it possible to obtain a high hardness at the surface and near the latter, and which also makes it possible to obtain good mechanical properties in the core of the components, has the disadvantage, however, of generating distortions which may lead to the components being scrapped or requiring to undergo expensive additional machining operations.

SUMMARY OF THE INVENTION

The object of the present invention is to remedy this drawback by providing a means for manufacturing steel components at least part of the surface of which is hardened by carburizing or by carbonitriding, especially at high temperature.

For this purpose, the subject of the invention is a process for manufacturing a mechanical component made of steel, in which a blank of the steel component is manufactured and a carburizing or carbonitriding treatment, especially at high temperature, of at least part of the surface of the blank of the component is carried out. According to this process, the chemical composition of the steel of which the component is composed comprises, by weight:

$0.15\% \leqq C \leqq 0.35\%$ $0\% \leqq Si \leqq 0.6\%$ $0\% \leqq Mn+Cr+Ni+Mo \leqq 5\%$ $0\% \leqq Al \leqq 0.1\%$ $0\% \leqq Cu \leqq 0.5\%$ $0\% \leqq S \leqq 0.15\%$ $P \leqq 0.03\%$ optionally, up to 0.02% tellurium, up to 0.04% selenium, up to 0.07% lead, up to 0.005% calcium, the balance being iron and impurities resulting from the smelting. In addition, the chemical composition of the steel is adjusted so that the Jominy curve of the steel is such that:

$45\ HRC \leqq J_3 \leqq 50\ HRC$ $39\ HRC \leqq J_{11} \leqq 47\ HRC$ $31\ HRC \leqq J_{25} \leqq 40\ HRC$ and so that the average values $J_{3m}$, $J_{11m}$, $J_{15m}$ and $J_{25m}$ of five Jominy tests are such that:

$|J_{11m}-J_{3m}\times 14/22-J_{25m}\times 8/22| \leqq 2.5$ HRC and $J_{3m}-J_{15m} \leqq 9$ HRC, and preferably $\leqq 8$ HRC.

Preferably, the Jominy curve is such that at least one of the following conditions is satisfied:

$10\times(J_{7m}-J_{11m})/(4\times(J_{15m}-J_{25m})) \leqq 2.15$ and:

$10\times(J_{7m}-J_{15m})/(8\times(J_{15m}-J_{25m})) \leqq 2$.

Preferably, the chemical composition of the steel is such that:

$0.2\% \leqq C \leqq 0.26\%$ $0.05\% \leqq Si \leqq 0.5\%$ $1\% \leqq Mn \leqq 1.6\%$ $0.4\% \leqq Cr \leqq 1.5\%$ $0.08\% \leqq Mo \leqq 0.27\%$ $0\% \leqq Ni \leqq 0.6\%$ $0.003\% \leqq Al \leqq 0.06\%$ $0\% \leqq Cu \leqq 0.3\%$ $0\% \leqq S \leqq 0.1\%$ $P \leqq 0.03\%$.

Better still, this chemical composition is such that:

$0.21\% \leqq C \leqq 0.25\%$ $0.1\% \leqq Si \leqq 0.45\%$ $1.1\% \leqq Mn \leqq 1.5\%$ $0.9\% \leqq Cr \leqq 1.4\%$ $0.09\% \leqq Mo \leqq 0.26\%$ $0\% \leqq Ni \leqq 0.6\%$ $0.005\% \leqq Al \leqq 0.05\%$ $0\% \leqq Cu \leqq 0.3\%$ $0\% \leqq Ti \leqq 0.05\%$ $P \leqq 0.03\%$.

Preferably, the nitrogen content of the steel is between 0.004% and 0.02%, and the steel may contain from 0% to 0.05% titanium.

The invention also relates to a carburizing steel, the chemical composition of which is that which has just been mentioned; this carburizing steel having a Jominy curve such that:

$45\ HRC \leqq J_3 \leqq 50\ HRC$ $39\ HRC \leqq J_{11} \leqq 47\ HRC$ $31\ HRC \leqq J_{25} \leqq 40\ HRC$ the average values $J_{3m}$, $J_{11m}$, $J_{15m}$ and $J_{25m}$ of five Jominy tests being such that:

$|J_{11m}-J_{3m}\times 14/22-J_{25m}\times 8/22| \leqq 2.5$ HRC and, $J_{3m}-J_{15m} \leqq 9$ HRC, and preferably $\leqq 8$ HRC.

Preferably, the average values $J_{7m}$, $J_{11m}$, $J_{15m}$ and $J_{25m}$ of five Jominy tests are such that at least one of the following conditions is satisfied:

$10\times(J_{7m}-J_{11m})/(4\times(J_{15m}-J_{25m})) \leqq 2.15$ and:

$10\times(J_{7m}-J_{15m})/(8\times(J_{15m}-J_{25m})) \leqq 2$.

The invention will now be described in greater detail, but in a non-limiting manner, and illustrated by the examples.

The inventors have recently and unexpectedly discovered that the distortions generated by the quenching which is carried out at the end of the carburizing treatment or at the end of the carbonitriding treatment could be considerably reduced, or even eliminated, as long as, in order to manufacture the component, a steel is used whose Jominy curve has practically no inflection points, unlike the Jominy curves of the steels normally used for this purpose. More specifically, they have discovered that it was desirable to use a steel containing;

from 0.15% to 0.35% carbon in order for the steel to be easily machinable and in order to obtain a sufficient toughness in the noncarburized or noncarbonitrided parts of the component;

up to 0.6% silicon in order to ensure sufficient deoxidation of the steel;

alloying elements, such as manganese, chromium, molybdenum and nickel, in amounts such as their sum remains less than 5% so as to provide sufficient hardenability, to adjust the shape of the Jominy curve and to adjust the mechanical properties of the component both in the core and in the carburized or carbonitrided regions;

up to 0.1% aluminium in order to complete the deoxidation and to control the grain size;

less than 0.5% copper, which is regarded as an impurity tending to decrease the ductility and toughness of the noncarburized or noncarbonitrided regions;

optionally, from 0% to 0.05% titanium in order to form hardening nitrides;

preferably, the nitrogen content, which element is always present and which reacts with aluminum or titanium in order to form nitrides, must be between 0.004% and 0.02%;

up to 0.15% sulfur in order to improve the machinability; and less than 0.03% phosphorus, which is an impurity having an unfavorable effect on the ductility and toughness.

The steel may furthermore contain up to 0.02% tellurium, up to 0.04% selenium, up to 0.07% lead and up to 0.005% calcium in order to improve the machinability. The balance of the composition is iron and impurities resulting from the smelting.

The chemical composition is adjusted so that the Jominy curve of the steel is such that:

$45\ \text{HRC} \leqq J_3 \leqq 50\ \text{HRC}$ $39\ \text{HRC} \leqq J_{11} \leqq 47\ \text{HRC}$ $31\ \text{HRC} \leqq J_{25} \leqq 40\ \text{HRC}$ and so that the average values $J_{3m}$, $J_{7m}$, $J_{11m}$, $J_{15m}$ and $J_{25m}$ of five Jominy tests are such that:

$|J_{11m}-J_{3m}\times 14/22-J_{25m}\times 8/22| \leqq 2.5$ HRC and, $J_{3m}-J_{15m} \leqq 9$ HRC, and preferably $\leqq 8$ HRC.

The Jominy curve is a curve which characterizes hardenability of the steel. It is obtained by measuring the hardness along a generatrix of a cylindrical test piece quenched by a water jet sprayed onto one of its ends. The hardness measured at a distance of ×mm from the sprayed end is called $J_x$. This test is well known to those skilled in the art. However, there is naturally quite a scatter in such a curve. This is why the shape of the Jominy curve is characterized here, on the one hand, by ranges of values for the points $J_3$, $J_{11}$ and $J_{25}$ and by the relationship: $|J_{11m}-J_{3m}\times 14/22-J_{25m}\times 8/22| \leqq 2.5$ HRC, which involves the averages of five different tests carried out on the same steel. More specifically, 5 identical tests are carried out in succession; for each test, at least the values of $J_3$, $J_7$, $J_{11}$, $J_{15}$ and $J_{25}$, are measured, five values for $J_3$, $J_7$, $J_{11}$, $J_{15}$ and $J_{25}$ are thus obtained and the average $J_{xm}$ of the five values is calculated for each point $J_x$. In this relationship, the vertical bars are the symbol known per se for the absolute value. The relationship itself, combined with the relationship $J_{3m}-J_{15m} \leqq 9$ HRC or $\leqq 8$ HRC, expresses the fact that the Jominy curve does not have pronounced inflection points.

The desired shape of the Jominy curve may be refined by requiring that it satisfy at least one of the following relationships:

$10\times(J_{7m}-J_{11m})/(4\times(J_{15m}-J_{25m})) \leqq 2.15$ and:

$10\times(J_{7m}-J_{15m})/(8\times(J_{15m}-J_{25m})) \leqq 2.$

Such Jominy curves may be obtained, in particular, with a steel in accordance with what has just been defined, but the chemical composition of which more specifically comprises, by weight:

from 0.2% to 0.26% and preferably from 0.21% to 0.25% carbon, in order not to have an excessively high hardness in the components before carburizing or carbonitriding and in order to achieve a good carburizability or carbonitridability;

from 1% to 1.6% and preferably from 1.1% to 1.5% manganese in order to obtain good internal soundness, in order to fix the sulfur and, in combination with chromium and molybdenum, to adjust the hardenability so as to obtain a satisfactory Jominy curve;

from 0.05% to 0.5% and preferably from 0.1% to 0.45% silicon;

from 0.4% to 1.5% chromium, and preferably from 0.9% to 1.4%, in order to harden the carburized or carbonitrided layer and, in combination with manganese and molybdenum, to adjust the hardenability so as to obtain a satisfactory Jominy curve;

from 0.08% to 0.27% and preferably from 0.09% to 0.26% molybdenum, in order to harden the carburized or carbonitrided layer, to contribute to increasing the resistance to oxidation and, in combination with manganese and chromium, to adjust the hardenability so as to obtain a satisfactory Jominy curve; the lower limit corresponds to a minimum value of the molybdenum content in order for this element to have a significant effect; and from 0% to 0.6% nickel in order to improve the impact strength of the component.

Preferably, the copper content remains less than 0.3%, the sulfur content is between 0.02% and 0.1% and, better still, remains less than 0.09%, and the aluminum content is between 0.003% and 0.06% and preferably lies between 0.005% and 0.05%.

As indicated above, the steel may furthermore contain one or more elements taken from tellurium, selenium, lead and calcium.

In order to manufacture a component according to the invention, a component blank is manufactured from a steel according to the invention, which blank is carburized or carbonitrided at high temperature and quenched in oil or gas, it being possible for the oil to be cold, warm or hot. The component blank may be manufactured, for example, by forging and by machining.

By way of example, components were produced from six steels according to the invention, the chemical compositions of which were:

| | C | Mn | Si | S | P | Ni | Cr | Mo | Cu | Al |
|---|---|---|---|---|---|---|---|---|---|---|
| A | 0.23 | 1.25 | 0.27 | 0.028 | 0.018 | 0.2 | 1.15 | 0.1 | 0.14 | 0.028 |
| B | 0.24 | 1.4 | 0.4 | 0.05 | 0.02 | 0.25 | 1.0 | 0.24 | 0.25 | 0.04 |
| C | 0.21 | 1.35 | 0.15 | 0.07 | 0.025 | 0.35 | 1.25 | 0.18 | 0.2 | 0.01 |
| D | 0.21 | 1.27 | 0.25 | 0.03 | 0.02 | 0.21 | 1.12 | 0.2 | 0.14 | 0.005 |
| E | 0.23 | 1.27 | 0.27 | 0.031 | 0.014 | 0.197 | 1.1 | 0.214 | 0.137 | 0.016 |
| F | 0.23 | 1.10 | 0.25 | 0.03 | 0.015 | 0.15 | 1.3 | 0.15 | 0.12 | 0.016 |

The Jominy curves of these steels were such that:

| (Hardnesses in HRC) | A | B | C | D | E | F |
|---|---|---|---|---|---|---|
| $J_3$ | 47.8 | 49.4 | 46.5 | 45.7 | 46.8 | 47.9 |
| $J_7$ | 45.5 | 48.5 | 45.4 | 45 | 45.8 | 45.5 |
| $J_{11}$ | 41.6 | 45.6 | 41.8 | 45 | 43.1 | 41.6 |
| $J_{15}$ | 39.1 | 43.3 | 39.4 | 43.1 | 39.4 | 39 |
| $J_{25}$ | 34.3 | 39.2 | 34.9 | 37.8 | 34.2 | 34.1 |
| $\lvert J_{11m}-J_{3m} \times 14/22 - J_{25m} \times 8/22\rvert$ | 1.29 | 0.09 | 0.48 | 2.17 | 0.88 | 1.28 |
| $J_{3m} - J_{15m}$ | 8.7 | 6.1 | 7.1 | 2.6 | 7.4 | 8.9 |
| $10 \times (J_{7m} - J_{11m})/(4 \times (J_{15m} - J_{25m}))$ | 2.02 | 1.75 | 2.00 | 0 | 1.30 | 1.97 |

-continued

| (Hardnesses in HRC) | A | B | C | D | E | F |
|---|---|---|---|---|---|---|
| $10 \times (J_{7m} - J_{15m})/(8 \times (J_{15m} - J_{25m}))$ | 1.66 | 1.59 | 1.66 | 0.45 | 1.54 | 1.65 |

After carburizing at 995° C. for 10 hours and quenching in warm oil at 98° C., the components exhibited no distortions requiring additional machining. Moreover, the carburizing operation was characterized by a carbon content of 0.94% at 0.1 mm beneath the surface.

By way of comparison, identical components are produced, under the same conditions, from steel of the 27MC5, 29MC5, 27MC5u, 27MC5r, 27CD4u, 30M5 and 20CD4 type according to the prior art. The compositions of these steels were:

| | C | Mn | Si | S | P | Ni | Cr | Mo | Cu | Al |
|---|---|---|---|---|---|---|---|---|---|---|
| 27MC5 | 0.23 | 1.18 | 0.24 | 0.033 | 0.015 | 0.13 | 1.08 | 0.04 | 0.16 | 0.024 |
| 29MC5 | 0.23 | 1.22 | 0.24 | 0.033 | 0.014 | 0.14 | 1.12 | 0.05 | 0.16 | 0.024 |
| 27MC5u | 0.26 | 1.19 | 0.25 | 0.033 | 0.015 | 0.09 | 1.09 | 0.04 | 0.13 | 0.025 |
| 27MC5r | 0.26 | 1.31 | 0.24 | 0.072 | 0.016 | 0.12 | 1.11 | 0.05 | 0.16 | 0.025 |
| 27CD4u | 0.27 | 0.74 | 0.25 | 0.032 | 0.012 | 0.15 | 1.08 | 0.22 | 0.17 | 0.028 |
| 30M5 | 0.30 | 1.41 | 0.24 | 0.072 | 0.015 | 0.13 | 0.43 | 0.06 | 0.16 | 0.025 |
| 20CD4 | 0.20 | 0.82 | 0.23 | 0.029 | 0.013 | 0.14 | 1.05 | 0.27 | 0.17 | 0.029 |

and the Jominy curves where such that:

| (Hardnesses in HRC) | 27MC5 | 29MC5 | 27MC5u | 27MC5r | 27CD4u | 30M5 | 20CD4 |
|---|---|---|---|---|---|---|---|
| $J_3$ | 48.8 | 49.7 | 49 | 48.5 | 48.9 | 50 | 45.3 |
| $J_7$ | 45.8 | 47.3 | 45.6 | 45.9 | 46.1 | 40.3 | 40.8 |
| $J_{11}$ | 40.3 | 43.2 | 40.4 | 41 | 39.8 | 31.9 | 34.4 |
| $J_{15}$ | 36.6 | 39.6 | 36.8 | 37.6 | 35.6 | 28.4 | 31.2 |
| $J_{25}$ | 32.7 | 35.1 | 33 | 33.7 | 31.6 | 24.4 | 27.8 |
| $\lvert J_{11m}-J_{3m} \times 14/22 - J_{25m} \times 8/22\rvert$ | 2.6 | 1.19 | 2.7 | 2.1 | 2.8 | 8.8 | 4.53 |
| $J_{3m} - J_{15m}$ | 12.2 | 10.1 | 12.2 | 10.9 | 9 | 21.6 | 14.1 |
| $10 \times (J_{7m} - J_{11m})/(4 \times (J_{15m} - J_{25m}))$ | 3.52 | 2.27 | 3.42 | 3.14 | 3.94 | 5.25 | 8 |
| $10 \times (J_{7m} - J_{15m})/(8 \times (J_{15m} - J_{25m}))$ | 5.9 | 2.13 | 2.89 | 2.66 | 3.28 | 3.72 | 3.87 |

After carburizing, the components required machining rework. Moreover, the carbon content in the carburized layer, at 0.1 mm below the surface, was only 0.8%. The latter result shows that, in addition to the lowest sensitivity to distortions, the steel according to the invention carburizes better than the steel according to the prior art.

What is claimed is:

1. A process for manufacturing a component made of steel, in which a blank of the steel component is manufactured and a carburizing or carbonitriding treatment, optionally at high temperature, of at least part of the surface of the blank of the component is carried out, wherein the chemical composition of the steel of which the component is composed comprises, by weight:

$0.15\% \leqq C \leqq 0.35\%$ $0\% \leqq Si \leqq 0.6\%$ $0\% \leqq Mn+Cr+Ni+Mo \leqq 5\%$ $0\% \leqq Al \leqq 0.1\%$ $0\% \leqq Cu \leqq 0.5\%$ $0\% \leqq S \leqq 0.15\%$ $P \leqq 0.03\%$ optionally, up to 0.02% tellurium, up to 0.04% selenium, up to 0.07% lead, up to 0.005% calcium, the balance being iron and impurities resulting from the smelting, the chemical composition being adjusted so that the Jominy curve of the steel is such that:

$45\ HRC \leqq J_3 \leqq 50\ HRC$ $39\ HRC \leqq J_{11} \leqq 47\ HRC$ $31\ HRC \leqq J_{25} \leqq 40\ HRC$ and so that the average values $J_{3m}$, $J_{11m}$, $J_{15m}$ and $J_{25m}$ of five Jominy tests are such that:

$|J_{11m}-J_{3m}\times 14/22-J_{25m}\times 8/22| \leqq 2.5$ HRC and, $J_{3m}-J_{15m} \leqq 9$ HRC.

2. The process as claimed in claim 1, wherein the steel is such that:

$J_{3m}-J_{15m} \leqq 8$ HRC.

3. The process as claimed in claim 1, wherein the average values $J_{7m}$, $J_{11m}$, $J_{15m}$ and $J_{25m}$ of five Jominy tests are such that:

$10\times(J_{7m}-J_{11m})/(4\times(J_{15m}-J_{25m})) \leqq 2.15$.

4. The process as claimed in claim 1, wherein the average values $J_{7m}$, $J_{11m}$, $J_{15m}$ and $J_{25m}$ of five Jominy tests are such that:

$10\times(J_{7m}-J_{15m})/(8\times(J_{15m}-J_{25m})) \leqq 2$.

5. The process as claimed in claim 1, wherein the chemical composition of the steel is such that:

$0.2\% \leqq C \leqq 0.26\%$ $0.05\% \leqq Si \leqq 0.5\%$ $1\% \leqq Mn \leqq 1.6\%$ $0.4\% \leqq Cr \leqq 1.5\%$ $0.08\% \leqq Mo \leqq 0.27\%$ $0\% \leqq Ni \leqq 0.6\%$ $0.003\% \leqq Al \leqq 0.06\%$ $0\% \leqq Cu \leqq 0.3\%$ $0\% \leqq S \leqq 0.1\%$ $P \leqq 0.03\%$.

6. The process as claimed in claim 5, wherein:

$0.21\% \leqq C \leqq 0.25\%$ $0.1\% \leqq Si \leqq 0.45\%$ $1.1\% \leqq Mn \leqq 1.5\%$ $0.9\% \leqq Cr \leqq 1.4\%$ $0.09\% \leqq Mo \leqq 0.26\%$ $0\% \leqq Ni \leqq 0.6\%$ $0.005\% \leqq Al \leqq 0.05\%$ $0\% \leqq Cu \leqq 0.3\%$ $0.02\% \leqq S \leqq 0.09\%$ $P \leqq 0.03\%$.

7. The process as claimed in claim 1, wherein the steel furthermore contains from 0% to 0.05% titanium.

8. The process as claimed in claim 1, wherein the nitrogen content of the steel is between 0.004% and 0.02%.

9. A carburizing or carbonitriding steel, wherein its chemical composition comprises, by weight:

$0.2\% \leqq C \leqq 0.26\%$ $0.05\% \leqq Si \leqq 0.5\%$ $1\% \leqq Mn \leqq 1.6\%$ $0.4\% \leqq Cr \leqq 1.5\%$ $0.08\% \leqq Mo \leqq 0.27\%$ $0\% \leqq Ni \leqq 0.6\%$ $0.003\% \leqq Al \leqq 0.06\%$ $0\% \leqq Cu \leqq 0.3\%$ $0\% \leqq S \leqq 0.1\%$ $P \leqq 0.03\%$ optionally, up to 0.02% tellurium, up to 0.04% selenium, up to 0.07% lead, up to 0.005% calcium, the balance being iron and impurities resulting from the smelting.

10. The carburizing or carbonitriding steel as claimed in claim 9, wherein its chemical composition is such that:

$0.21\% \leqq C \leqq 0.25\%$ $0.1\% \leqq Si \leqq 0.45\%$ $1.1\% \leqq Mn \leqq 1.5\%$ $0.9\% \leqq Cr \leqq 1.4\%$ $0.09\% \leqq Mo \leqq 0.26\%$ $0\% \leqq Ni \leqq 0.6\%$ $0.005\% \leqq Al \leqq 0.05\%$ $0\% \leqq Cu \leqq 0.3\%$ $0.02\% \leqq S \leqq 0.09\%$ $P \leqq 0.03\%$.

11. The carburizing or carbonitriding steel as claimed in claim 9, wherein its Jominy curve is such that:

$45\ HRC \leqq J_3 \leqq 50\ HRC$ $39\ HRC \leqq J_{11} \leqq 47\ HRC$ $31\ HRC \leqq J_{25} \leqq 40\ HRC$ the average values $J_{3m}$, $J_{11m}$, $J_{15m}$ and $J_{25m}$ of five Jominy tests are such that:

$|J_{11m}-J_{3m}\times 14/22-J_{25m}\times 8/22| \leqq 2.5$ HRC and, $J_{3m}-J_{15m} \leqq 9$ HRC.

12. The carburizing or carbonitriding steel as claimed in claim 11, wherein:

$J_{3m}-J_{15m} \leqq 8$ HRC.

13. The carburizing or carbonitriding steel as claimed in claim 11, wherein the average values $J_{7m}$, $J_{11m}$, $J_{15m}$ and $J_{25m}$ of five Jominy tests are such that:

$10\times(J_{7m}-J_{11m})/(4\times(J_{15m}-J_{25m})) \leqq 2.15$.

14. The carburizing or carbonitriding steel as claimed in claim 11, wherein the average values $J_{7m}$, $J_{11m}$, $J_{15m}$ and $J_{25m}$ of five Jominy tests are such that:

$10\times(J_{7m}-J_{15m})/(8\times(J_{15m}-J_{25m})) \leqq 2$.

15. The steel as claimed in claim 9, wherein it furthermore contains from 0% to 0.05% titanium.

16. The steel as claimed in claim 9, wherein its nitrogen content is between 0.004% and 0.02%.

* * * * *